US006612095B2

(12) United States Patent
Hartness

(10) Patent No.: US 6,612,095 B2
(45) Date of Patent: Sep. 2, 2003

(54) PACKING AND UNPACKING MACHINE

(75) Inventor: Thomas Patterson Hartness, Greenville, SC (US)

(73) Assignee: Hartness International, Inc., Greenville, SC (US)

( * ) Notice: Subject to any disclaimer, the term of this patent is extended or adjusted under 35 U.S.C. 154(b) by 0 days.

(21) Appl. No.: 10/160,908

(22) Filed: Jun. 3, 2002

(65) Prior Publication Data

US 2002/0150458 A1 Oct. 17, 2002

Related U.S. Application Data

(63) Continuation-in-part of application No. 09/418,619, filed on Oct. 15, 1999.

(51) Int. Cl.[7] ..... B65B 1/04

(52) U.S. Cl. ..... 53/247; 53/543; 198/432; 198/430; 198/470.1; 198/803.7

(58) Field of Search ..... 198/432, 433, 198/431, 418.6, 430, 470.1, 803.7; 53/473, 202, 246, 247, 248, 249, 251, 253, 276, 475, 543

(56) References Cited

U.S. PATENT DOCUMENTS 1,636,421 A 7/1927 Knott
2,928,693 A * 3/1960 Cannon, Jr. ..... 294/83
3,825,980 A * 7/1974 Moore ..... 24/230
3,864,890 A * 2/1975 Ullman ..... 53/26
3,958,685 A * 5/1976 McDonald et al. ..... 198/179
4,169,621 A * 10/1979 McGill ..... 194/116
4,320,914 A * 3/1982 Simon ..... 294/88
4,483,436 A * 11/1984 Krishnakumar et al. .... 198/648
4,585,369 A * 4/1986 Manesse et al. ..... 403/322
5,553,442 A * 9/1996 Fadaie ..... 53/445
5,555,709 A * 9/1996 Savigny et al. ..... 53/570
5,701,719 A * 12/1997 Neukam ..... 53/247
5,727,365 A * 3/1998 Lashyro et al. ..... 53/448
5,862,649 A * 1/1999 Benz ..... 53/447
6,003,286 A * 12/1999 Goodman ..... 53/537
6,209,293 B1 * 4/2001 Powers ..... 53/475
6,269,615 B1 * 8/2001 Amborn et al. ..... 53/493
6,286,290 B1 * 9/2001 Fluck ..... 53/54
6,393,800 B1 * 5/2002 Schwenke ..... 53/329

* cited by examiner

*Primary Examiner*—Christopher P. Ellis
*Assistant Examiner*—Rashmi Sharma
(74) *Attorney, Agent, or Firm*—McNair Law Firm, P.A.

(57) ABSTRACT

A pick-up member for use with an apparatus for transporting a container from a pick-up station to a deposit station. The pick-up member being substantially formed of plastic and includes a bell-shaped head having a longitudinal bore for receiving containers and transverse bores intersecting the longitudinal bore and causing transverse movement engaging members for engaging with the containers. A control mechanism is provided to control the position of the engaging members.

15 Claims, 5 Drawing Sheets

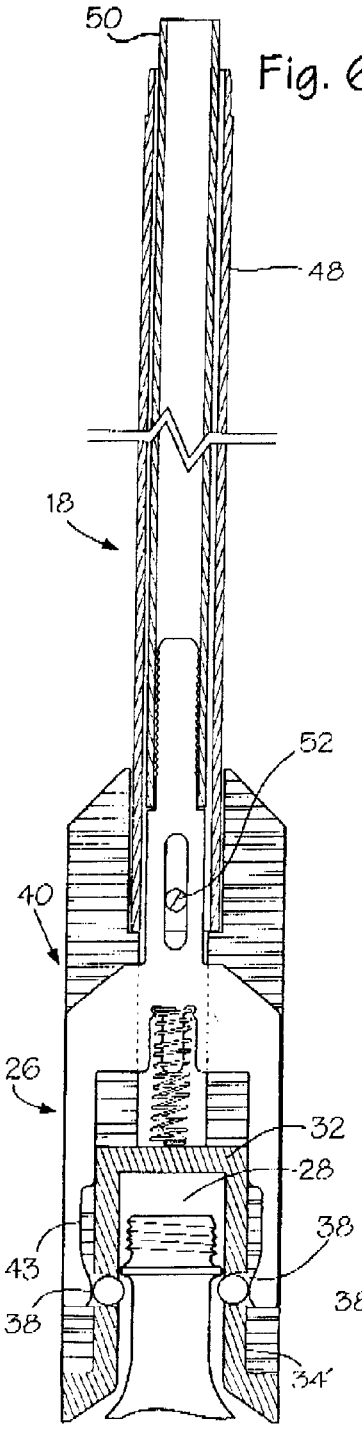
Fig. 6a
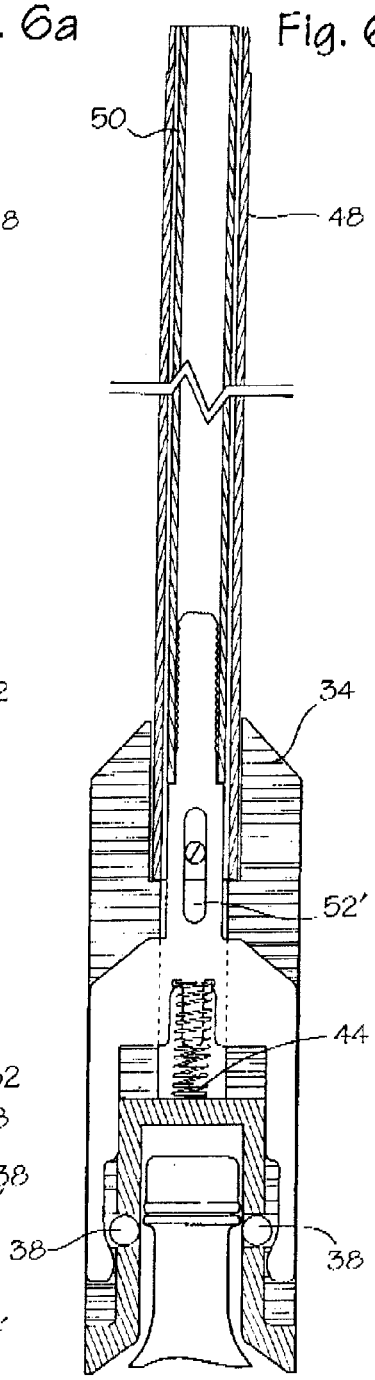
Fig. 6b
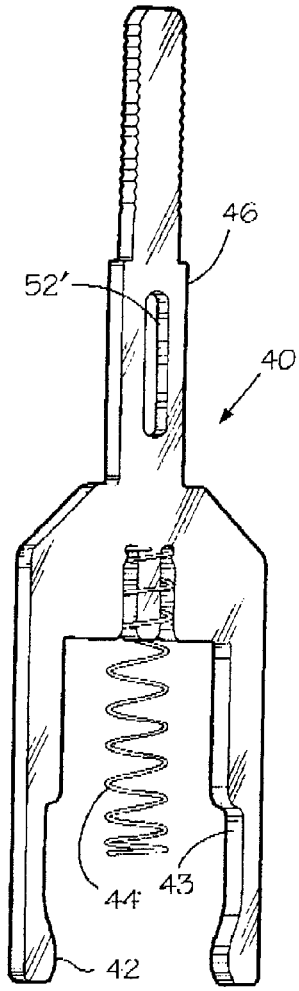
Fig. 7
Fig. 8
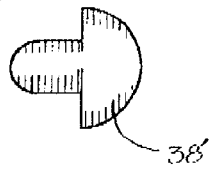

PACKING AND UNPACKING MACHINE

This application is a continuation-in-part of Ser. No. 09/418,619, filed Oct. 15, 1999, the disclosure of which is incorporated herewith.

BACKGROUND OF THE INVENTION

This invention is primarily directed to a pick-up mechanism which operates with a packing machine which operates to move containers between a pick-up station and a deposit station. Such type apparatus is well known and normally uses pivoting gripping members, which are operated by way of pivoting linkages. Generally, the pick-up and gripping devices are formed of forged metal, which is expensive to fabricate. Also, the control linkages are fairly complicated and time consuming to assemble and adjust. This aggravates the change over procedure required to accommodate different size containers.

U.S. Pat. Nos. 3,864,890 and 4,169,621 are directed to examples of this known structure.

The instant gripping or pick-up member is formed of primarily plastic members either extruded or molded. The lone metal members comprise a unitary stamped metal piece and a spring. The structure is first a low cost product. It can be quickly assembled as there are only eight independent elements and adjustment is substantially negligible. Also, the change over procedure to accommodate different size containers is easily performed.

It is a primary object of this invention to provide a gripping member, which is easily installed with the container transporting apparatus.

Another object of the invention is a gripping member, which is inexpensive to manufacture.

Another object of the invention is a gripping apparatus, which operates substantially error free.

Another object of the invention is a gripping apparatus comprised essentially of plastic components.

Another object of the invention is a gripping apparatus, which is easily interchanged with the transporting apparatus.

Another object of the invention is a gripping apparatus, which is easily adjusted to operate synchronously with the transporting apparatus.

SUMMARY OF THE INVENTION

The instant invention is directed to an apparatus for transferring containers from a pick-up position to a deposit position, which includes a pick-up and a guide grid carrying a plurality of guide members. The pick-up grid, which is movable between the pick-up position and the deposit position, carries a plurality of pick-up members. Each pick-up member includes a head having an axial bore, which extends from one end thereof and a plurality of transverse bores which engage with the axial bore. Each transverse bore carries an engaging member which is capable of movement between an engaging position where the engaging member is positioned to extend inwardly beyond the periphery of the axial bore and a release position where the engaging member is moved outside the periphery of the axial bore. Each pick-up member includes a control mechanism.

The apparatus is constructed so that when the guide grid positions the guide members in their active position the pick-up grid positions the pick-up members in the pick-up position with the heads located about the containers. The control mechanism is actuated to move the engaging members into the engaging position and into gripping contact with the containers. Also, when the guide grid positions the guide fingers and the pick-up grid positions the pick-up members in the deposit position, an engagement member actuates the control mechanism to allow the engaging members to move into the release position allowing the containers to be released into the deposit position.

The control mechanism includes a reciprocating cam carried by each head. The cam is movable between an engaging position in which the engaging member is cammed into the engaging position and a non-engaging position in which the engaging member is allowed to move into the release position. It is preferred that both the head and the engaging members are formed of plastic. Also, the engaging members are shaped in the form of a ball or a pin.

There is a tube connecting each pick-up grid with each head. Also, there is a rod, carried in each tube and extending above its upper end. This allows for movement of the pick-up grid relative the engagement member to bring about relative movement between the head and the cam.

The invention is further directed to a container pick-up member, which includes a shaped head, preferably, bell shaped, having an upper and lower end with an axial bore extending from its lower end for receiving containers. There are transverse bores through the head, which engage, with the axial bore. Each transverse bore carries an engaging member, which moves laterally into and out of the axial bore. Also, there are longitudinal grooves formed in the head and which engage with respective of the transverse bores. A camming member is carried in each groove for movement longitudinally of the head and transverse of the associated of the transverse bores. Longitudinal movement of the camming members control the position of the engaging members within the transverse bores.

There is a tube secured with the upper end of the head, which connects the head with the pick-up grid. Also, there is a rod passing through the tube, which is in contact with the actuator plate for controlling the downward movement of the cam into the release position. A resilient member is engaged with the camming members, which continuously urge them toward the upper end of the head. Each camming member is carried by a camming fork, which is supported on the head.

It is preferred that all major components be made of plastic either injection molded or extruded. Generally only the fork carrying the cams is made of metal.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 6*a* is a sectional side view of the pick-up mechanism with the gripping members in the engaged position;

FIG. 6*b* is similar to FIG. 5*a* but showing the engaging members in the disengaged position;

FIG. 7 is an exploded perspective view of the camming fork; and

FIG. 8 is a side view of another gripping member.

DESCRIPTION OF A PREFERRED EMBODIMENT

Figure 1:
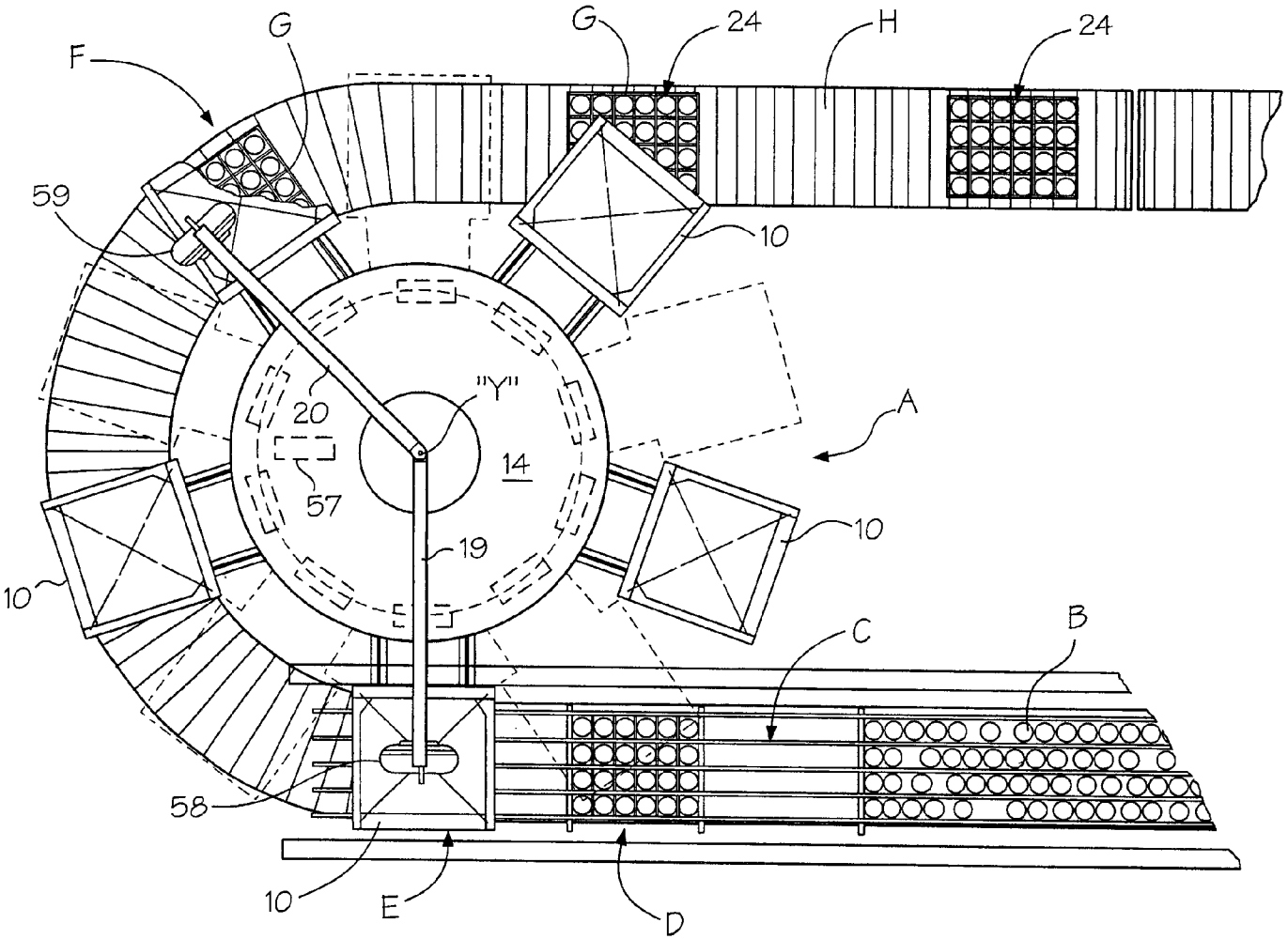
FIG. 1 is a top or plan view of a portion of the transporting apparatus equipped with the pick-up mechanism of the invention.

Referring now to the drawings, the invention will now be described in more detail.

Figure 2:
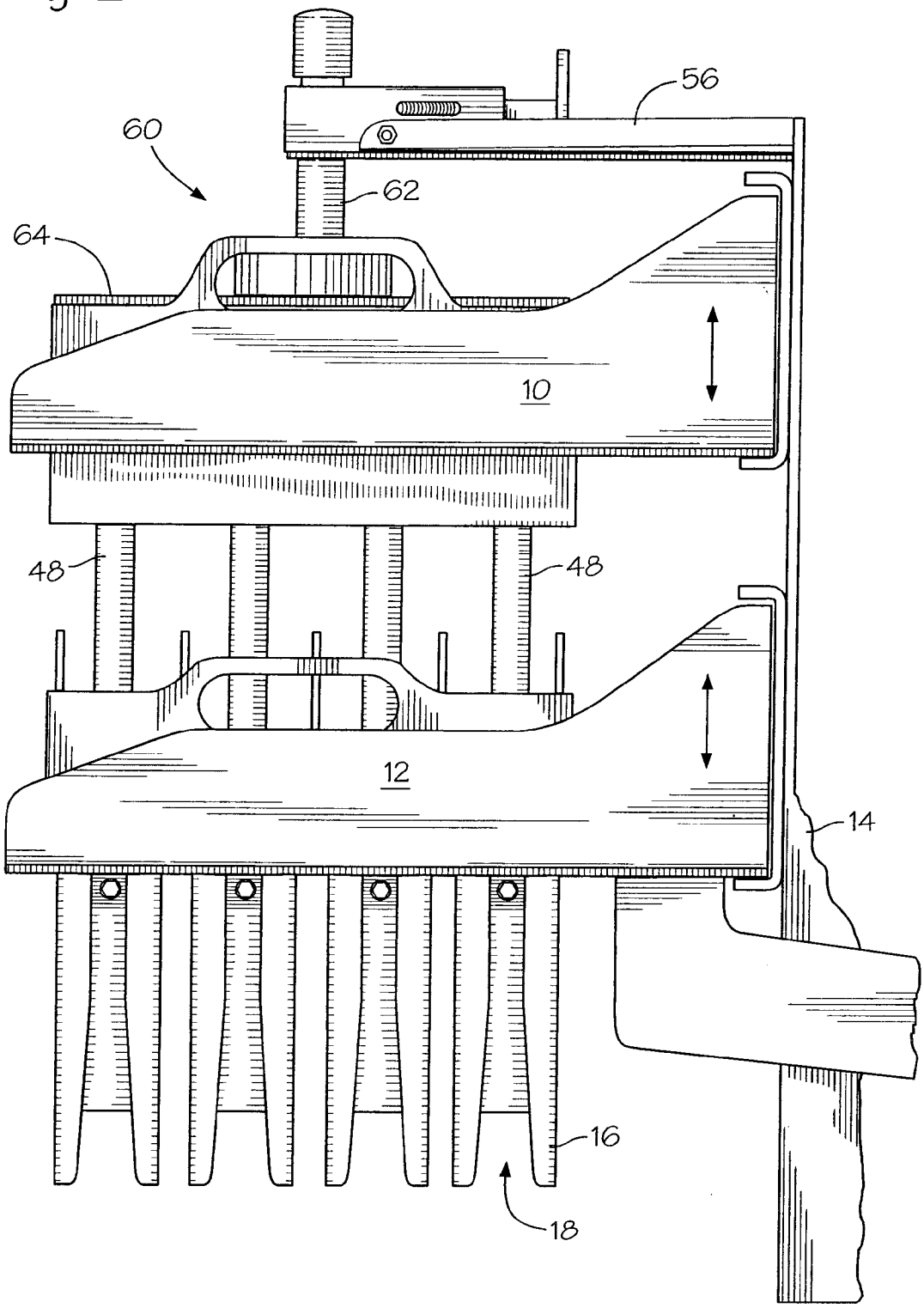
FIG. 2 is a diagrammatic sectional side view of transporting apparatus.
Figure 3:
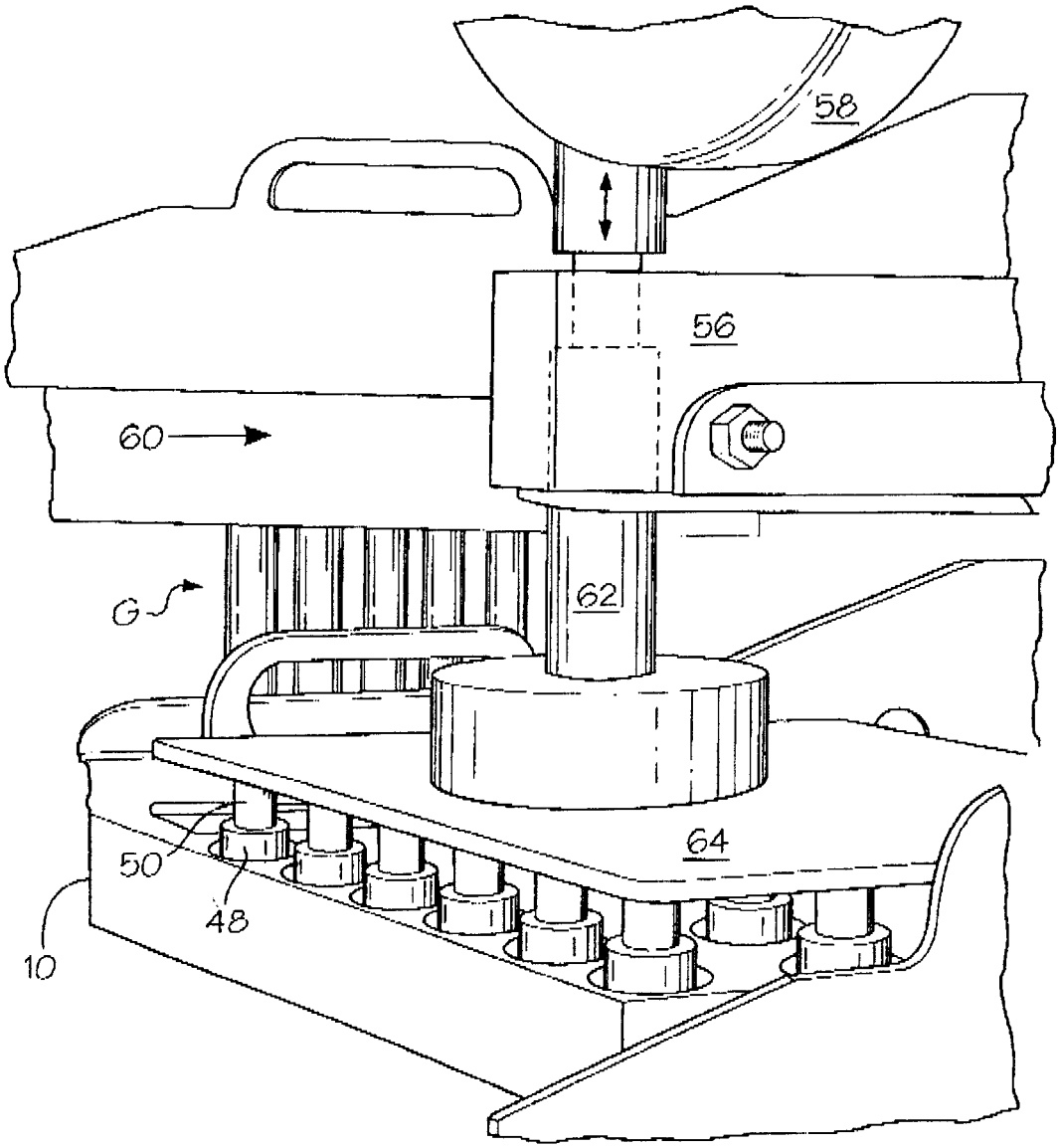
FIG. 3 is a diagrammatic sectional view of the actuator.
Figure 4:
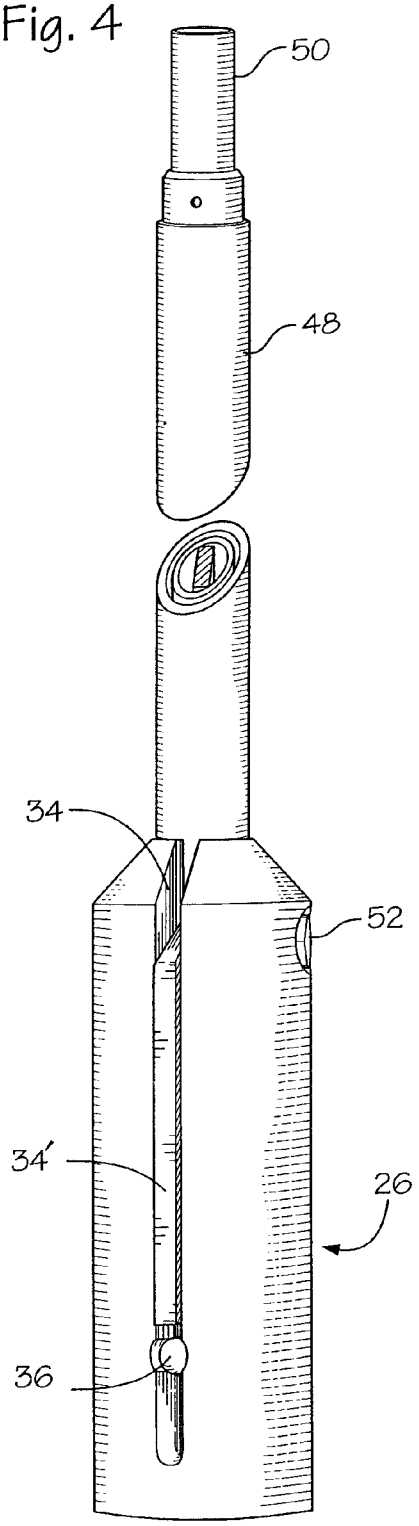
FIG. 4 is a sectional side view of the pick-up mechanism.
Figure 5:
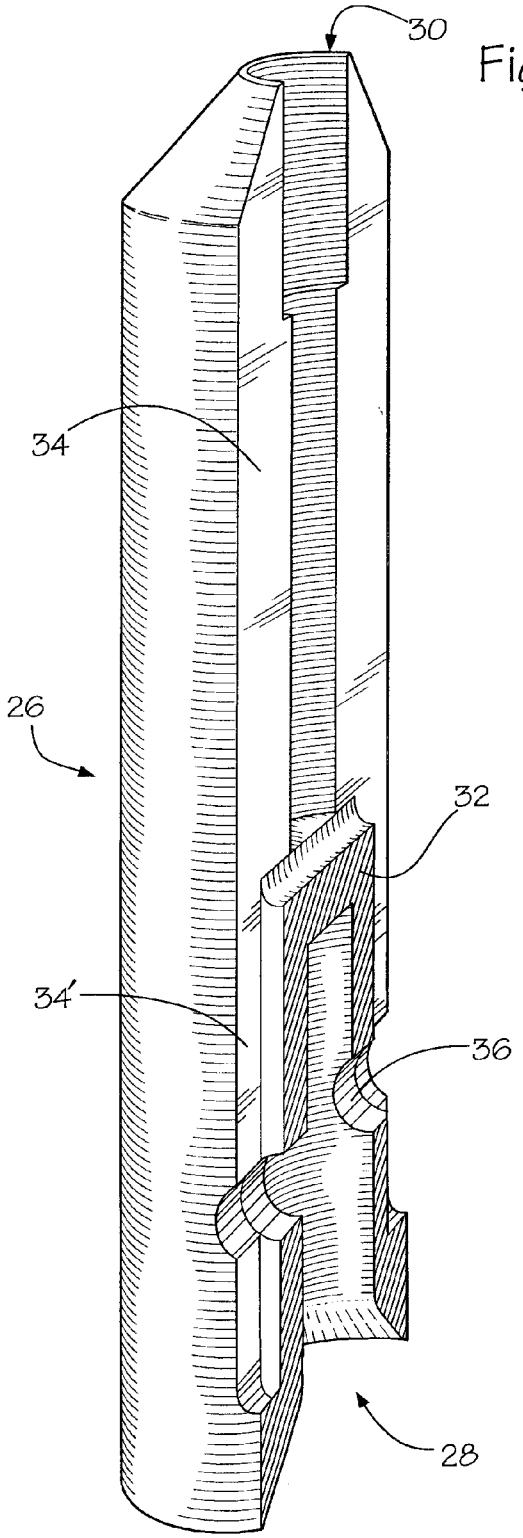
FIG. 5 is a perspective sectional view of the head of the pick-up member.

Turning now to FIGS. 1–3 the general environment in which the novel pick-up members of the invention operate. FIG. 1 shows a transfer apparatus A which operates to deliver containers B along a feed conveyor C, to group a selected number of containers into slug D, to then transfer slug D to pick-up station E where the slug of containers is picked up and transported to deposit station F. At the deposit station the slug of containers is deposited into a container G which is removed by conveyor H. This operation and apparatus of performing is described in more detail in co-pending application to which reference is here made.

More specifically, the apparatus with which the novel pick-up members operate include pick-up grid 10 which is carried by rotating tower 14 in a position above guide grid 12 as shown in FIG. 2. The pick-up and guide grids are carried about axis Y by tower 14 and are also caused to move vertically along a plane arranged about the periphery of the rotating tower in known manner. This vertical movement positions the guide grid and the pick-up grids into and out of a pick-up position, a carrying position and a deposit position.

Returning again to FIGS. 1 and 2, as rotating tower 14 moves the pick-up grid into pick-up position E, the pick-up grid is in its most raised position. Upon reaching the pick-up position pick-up grid 10 along with guide grid 12 are lowered into the pick-up position. Fingers 16 descend around each container of the slug. Slightly after but substantially simultaneously, pick-up grid 10 lowers pick-up members 18 into position over the upper end of each container. A transfer apparatus, more fully disclosed in U.S. application Ser. No. 09/418,619, including engagement member 58 actuates the pick-up member 18 to engage with the containers. Pick-up grid 10 is then raised as pick-up and guide grids 10 and 12 continue to move about axis Y. Upon reaching deposit position F, pick-up and guide grids, 10, 12 are again lowered placing the containers into boxes or packages. At this time a releasing mechanism or engaging mechanism 59 of the transfer apparatus actuates pick-up members 18 to release the containers as pick-up and guide grids 10 and 12 are raised leaving the containers in boxes 24 which are removed via conveyor H.

Turning now to FIGS. 4–7, the structure of pick-up member 18 will be described. Preferably, the pick-up member is made substantially of plastic, which substantially reduces the cost of manufacture and its overall weight. Pick-up member 18 consists of bell or receiving end 26, which includes an axial bore 28 from its lower end to a point generally around its mid-point. The bore is of a size slightly larger than the upper end of the container to be moved. A second axial bore 30 is formed in bell 26 from its upper end terminating just short of bore 28 forming shelf 32. In opposed positions along the outer surface of bell 26 are formed vertical slots 34 which extend about half the length of the bell terminating with shelf 32. Slots 34 are cut into the bore 30. From shelf 32 downward to just short of the lower end of bell 26 slots 34', which merge with slots 34 are cut to about 1 cm. At a point generally midway of axial bore 28 a pair of opposed transverse bores 36 are cut to extend from the inner surface of slots 34' into bore 28. An engaging member is positioned in each transverse bore. The engaging member is preferably a molded plastic ball 38 as shown in FIGS. 6*a* and *b* but can alternatively comprise pin 38' as shown in FIG. 8. The engaging member is of a size that a portion thereof may extend inwardly of the outer wall of bore 28 and into the area of the bore when urged inward. The engaging member may also be removed from this area. The size of transverse bores 36 is such as to freely fit about ball 38 or pin 38' allowing transverse movement thereof along the bore. Also in the case of ball 38, the inner ends of transverse bores 36 are slightly reduced in size allowing only a portion of the ball to penetrate into the cavity of the bore.

Fork 40 is formed with a pair of arms each carrying cam member 42 adjacent its lower end. Cams 42 are arranged just below recesses 43 formed in each arm. Centrally of fork 40 is arranged a resilient member such as spring 44 and extension 46 forms the upper portion of the fork.

Fork 40 is adapted to extend across axial bore 30 with its arms fitted into slots 34 and extending into slots 34'. The arms are of a length to allow cams 42 to extend below transverse bores 36 as shown in FIG. 6*b*.

Spring 44 is positioned in axial bore 30 to be located between the medial portion of fork 40 and shelf 32. Spring 44 acts to urge fork 40 away from the lower end of bell 26.

A tube 48 fits into the upper end of axial bore 30 and is secured in position by bolt 52. The upper end of tube 48 is adapted to secure with pick-up grid 10 as shown generally in FIGS. 2 and 3. Rod 50 is carried within tube 48 and is of a length to normally extend above the upper end thereof. See FIG. 3. The lower end of rod 50 secures with extension 46. Bolt 52 passes through slot 52' in extension 46 to allow vertical movement of fork 40 and rod 50.

In operation, the control mechanism, which includes rod 50, fork 40, cams 42 and engaging members 38 or 38' is normally positioned in the engaging position as shown in FIG. 6*a*. In this position spring 44 locates rod 50 above the end of tube 48, fork 40 spaced above shelf 32 and cams 42 opposite transverse bores 36 in position to urge engaging members 38 into the engaging position.

In this position, as shown in FIG. 6*a*, portions of the engaging members extend into axial bore 28 to engage with and grip the upper end of a container.

In the disengaged position, rod 50 is moved against spring 44 to be substantially flush with the upper end of tube 48, cams 42 are moved below bores 36 allowing engaging members 38 to move into the area of recesses 43 freeing the container end.

The transfer apparatus, as best shown in FIGS. 1 and 3, includes a pair of stationary arms 19, 20 which extend over the path of conveyors C and H in a position substantially above the pick-up position E and the deposit position F. Each arm carries an engagement member 58, 59 at its end.

Each pick-up grid 10 includes an actuating member 60; see FIGS. 2 and 3, which includes an extension 62 and a plate 64. Plate 64 is supported by the upper ends of rods 50. An arm 56 connects with tower 12 and forms a guide for extension 62.

In operation, tower 12 carries pick-up and guide grids 10, 12 about axis Y and also in a vertically reciprocating motion. As a pair of grids 10, 12 move over pick-up position E and are lowered into position over the containers, engagement member 58 strikes extension 62 lowering plate 64 which in turn lowers each cam 42 placing the pick-up members into their disengaged position which allows the upper portion of the containers of the slug to be positioned in bores 28. As extension 62 moves past, engagement member 38 plate 64 is raised by springs 44 which also move forks 40 to upwardly moving cams 42 into engagement with engaging members 38 locking the containers with the pick-up members.

As the grids 10, 12 are lowered into the deposit position positioning the containers in boxes or suitable packages, engagement member 59 engages with extension 62 causing a repeat of the above described action and releasing the containers into box G. Box G is removed by conveyor H while grids 10, 12 move to repeat the operation.

While a preferred embodiment of the invention has been described using specific terms, such description is for illustrative purposes only, and it is to be understood that changes and variations may be made without departing from the spirit or scope of the following claims.

What is claimed is:

1. An apparatus for transferring containers from a pick-up position to a deposit position comprising:

a guide grid carrying a plurality of guide fingers;

a pick-up grid movable between said pick-up position and said deposit position, said pick-up grid carrying a plurality of pick-up members;

each said pick-up member including a head having an axial bore, extending from one end thereof, and a plurality of transverse bores engaging with said axial bore, each said transverse bore carrying an engaging member for movement between an engaging position where said engaging member is moved to extend beyond the periphery of said axial bore and a release position where said engaging member is moved outside the periphery of said axial bore;

each said pick-up member including a control mechanism associated with said control grid; wherein, when said pick-up grid positions said pick-up members in said pick-up position with said heads located about said containers, said control mechanism is actuated to move said engaging members into said engaging position and into gripping contact with said containers and when said pick-up grid positions said pick-up members in said deposit position said control grid actuates said control mechanism to allow said engaging members to move into said release position allowing said containers to be released into said deposit position.

2. The apparatus of claim 1 wherein, at least one of said head and said engaging member is molded plastic.

3. The apparatus of claim 1 wherein, said control mechanism includes a reciprocating cam carried by each said head, said cam being movable between an engaging position in which said engaging member is cammed into said engaging position and a non-engaging position in which said engaging member is allowed to move into said release position.

4. The apparatus of claim 1 wherein, said engaging member comprises one of a ball and a pin.

5. The apparatus of claim 3 including a tube connecting each said pick-up grid with each said head.

6. The apparatus of claim 5 including an engagement member and a rod, carried in each said tube, connecting said control grid with said cam; wherein movement of said pick-up relative said engagement member causes said rod to move said cam between said engaging and said non-engaging positions.

7. In an apparatus for transferring containers from a pick-up station to a deposit station which includes a guide grid and a pick-up grid operating in synchronism;

a plurality of pick-up members carried by said pick-up grid, each said pick-up member comprising:

a shaped head having an upper and lower end with an axial bore extending from said lower end for receiving the containers;

transverse bores engaging with said axial bore, each said transverse bore carrying an engaging member for lateral movement into and out of said axial bore;

longitudinal grooves formed in said head and engaging with respective of said transverse bores;

a camming member carried in each said groove for movement longitudinally of said head and transverse of the associated of said transverse bores; wherein, movement of said camming members controls the position of said engaging members along said transverse bores.

8. The pick-up member of claim 7 including a tube secured with said upper end of said head for securing said head with said pick-up grid.

9. The pick-up member of claim 8 including a rod passing through said tube, said rod being secured with said camming member for controlling said movement of said cam.

10. The pick-up member of claim 7 including a resilient member continuously urging said camming members toward said upper end.

11. The pick-up member of claim 7 wherein each said camming member is carried by a camming fork supported on said head.

12. The pick-up member of claim 11 including a resilient member carried by said head urging said camming fork away from said lower end.

13. The pick-up member of claim 7 wherein said head is molded plastic.

14. The pick-up member of claim 7 wherein said engaging members are plastic.

15. The pick-up member of claim 7 wherein said head is bell shaped.

* * * * *